US006755496B2

(12) United States Patent
Nishikori et al.

(10) Patent No.: US 6,755,496 B2
(45) Date of Patent: Jun. 29, 2004

(54) INK JET PRINTING APPARATUS AND METHOD WITH SUPPRESSED BLEEDING OF INKS

(75) Inventors: Hitoshi Nishikori, Tokyo (JP); Naoji Otsuka, Kanagawa-ken (JP); Hitoshi Sugimoto, Kanagawa-ken (JP); Kiichiro Takahashi, Kanagawa-ken (JP); Osamu Iwasaki, Tokyo (JP); Minoru Teshigawara, Kanagawa-ken (JP); Takeshi Yazawa, Kanagawa-ken (JP); Toshiyuki Chikuma, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/066,768

(22) Filed: Feb. 6, 2002

(65) Prior Publication Data

US 2002/0105559 A1 Aug. 8, 2002

(30) Foreign Application Priority Data

Feb. 6, 2001 (JP) ..... 2001-030185

(51) Int. Cl.[7] ..... B41J 29/38
(52) U.S. Cl. ..... 347/12
(58) Field of Search ..... 347/12, 41, 43, 347/15

(56) References Cited

U.S. PATENT DOCUMENTS

| | | | | |
|---|---|---|---|---|
| 5,594,478 A | * | 1/1997 | Matsugbara et al. | 347/41 |
| 5,917,519 A | | 6/1999 | Arai et al. | 347/41 |
| 5,975,678 A | | 11/1999 | Kanematsu et al. | 347/43 |
| 6,116,720 A | | 9/2000 | Inui et al. | 347/43 |
| 6,164,756 A | | 12/2000 | Takahashi et al. | 347/43 |
| 6,367,912 B1 | * | 4/2002 | Kishimoto et al. | 347/43 |
| 6,416,150 B1 | | 7/2002 | Kimura | 347/14 |
| 6,474,775 B1 | * | 11/2002 | Okamoto | 347/37 |
| 6,540,336 B2 | | 4/2003 | Kubota et al. | 347/65 |

FOREIGN PATENT DOCUMENTS

| | | |
|---|---|---|
| EP | 0985532 A2 | 3/2000 |
| EP | 0985532 | 3/2000 |
| JP | 4-173250 | 6/1992 |

OTHER PUBLICATIONS

Fujimura Yoshihiko; "Ink Jet Recording Method"; Patent Abstracts of Japan; Fuji Xerox Co Ltd; Publication No. 04173250, Publication Date Jun. 19, 1992.

* cited by examiner

*Primary Examiner*—Stephen D. Meier
*Assistant Examiner*—Alfred E Dudding
(74) *Attorney, Agent, or Firm*—Fitzpatrick, Cella, Harper & Scinto

(57) ABSTRACT

An ink jet printing apparatus including: a print unit having a polarity of ejection outlet arrays, for ejecting ink,; a scan unit for scanningly moving the print unit relative to the print medium in a main scan direction; and a feed unit for feeding the print medium relative to the print unit in a direction which is different from the main scan direction, wherein an image is formed on the print medium while repeating a scanning operation of the scanning unit and a feeding operation by the feeding unit. The apparatus also includes an information obtaining unit for obtaining image information; and a selecting unit for selecting at least one of the ejection outlet arrays to effect printing for the image data in a predetermined area, on the basis of the information obtained by the information obtain unit about image formations.

22 Claims, 11 Drawing Sheets

PTRN 0

PTRN 1

PTRN 2

PTRN 3

| TEMP (℃) | | HD RANK | THRESHOLD | | |
|---|---|---|---|---|---|
| ≧ | < | | value1 | value2 | value3 |
| — | 20 | −1 | 37 | 56 | 90 |
| — | 20 | 0 | 35 | 53 | 90 |
| — | 20 | 1 | 33 | 50 | 90 |
| 20 | 30 | −1 | 35 | 53 | 90 |
| 20 | 30 | 0 | 33 | 50 | 90 |
| 20 | 30 | 1 | 31 | 48 | 90 |
| 30 | — | −1 | 33 | 50 | 90 |
| 30 | — | 0 | 31 | 48 | 90 |
| 30 | — | 1 | 29 | 46 | 90 |

FIG. 12

INK JET PRINTING APPARATUS AND METHOD WITH SUPPRESSED BLEEDING OF INKS

FIELD OF THE INVENTION AND RELATED ART

The present invention relates to an ink jet printing method and apparatus for effecting image formation on a print medium using ink.

In an ink jet printing apparatus, ink droplets ejected from a printing head carried on a printing apparatus are deposited on a print medium, and the ink is fixed and colored on the print medium, thus providing a print of the image. A color image printing is possible when a plurality of color inks, such as cyan, magenta, yellow and black inks are used. In an usual ink jet printing apparatus, a printing head is provided with a plurality of ejection outlet arrays corresponding to the respective colors of the ink. From the ejection outlet arrays, respective colors of inks are detected to provide a color image print.

In order to prevent bleeding of the image formed on the print medium, the ink having a relatively high perviousness relative to the print medium such as paper is often used for the color or chromatic ink. On the other hand, as for the black ink which is frequently used to form letter images, the ink having a relatively low perviousness is often used to provide clear ages of the letter images. This is because when the black ink having a high perviousness is deposited on the paper, the ink penetrates relatively quickly along the fibers of the paper, and therefore, the edges of the letter image may be non-smooth.

In such an ink jet printing apparatus using the black ink having the relatively low perviousness and the color ink having the relatively high perviousness, there is a liability of a problem that when the black ink and the color ink are contacted to each other on the print medium, the ink bleeding occurs at the boundary between the black ink and the color ink (this problem will hereinafter be called "black-color bleeding".

FIG. 1 shows an example of ejection outlet array arrangement in a printing head which is designed for avoiding such a problem. The printing head PH shown in this Figure comprises an ejection outlet array Bkl for ejecting the black ink (Bk), and a plurality of ejection outlet arrays for ejected the cyan (C), the magenta (M) and the yellow (Y), respectively. The shown arrangement of the ejection outlet arrays is applicable to a printing head which completes printing on the print medium by repetition of the recording operation with reciprocal scanning in the main scan direction of the printing head and recognition of feeding the print medium (paper feeding operation), that is, a so-called serial type recording device. In the Figure, an arrow M indicates the main scan direction. In the case of bidirectional print in which the ink is ejected in both of the forward and backward movements of the print head, two arrays of each of cyan, magenta and yellow ejection outlets are provided symmetrically with respect to the print scanning direction, as indicated by reference characters C1, C2, M1, M2, Y1, Y2, in order to provide the same ejection orders of the color inks respective of the directions of the scanning.

When only a black image is to be printed, all of the ejection outlets for the black ink are used, but when a color image is to be printed, only the portion, indicated by "a" of the black ejection outlets is used, and as for the color ejection outlets, the portion indicated by "b" is used.

With this structure, the black image data are printed on the print medium by the scanning of the printing head in the horizontal direction (main-scanning) in the Figure, using only the ejection outlet array a, and thereafter, the print medium is fed through a distance an in the vertical direction (sub-scan, or paper feeding). In the next main-scanning of the printing head, the printing is effected by the color ejection outlet arrays b, by which the image printing is completed for 1 print region. When the color ejection outlet array b carries out the printing, the black ejection outlet array portion a prints the black part of the image for the next print region.

According to this method, the color ink is ejected onto the print medium in the print scanning subsequent to the scanning of ejecting the black ink onto the print medium. Therefore, as compared with the case in which the black ink and the color ink are simultaneously ejected onto the same print region in one print scanning, there is a time period in which the black ink penetrates into the print medium and fixes, prior to the ejection of the color ink. Therefore, this method is advantageous from the stern point of suppressing the occurrence of the black-color bleeding.

However, when the bi-directional print is effected using such a printing head, the black image is printed in the forward scanning, and then, the color ink image is printed in the subsequent backward scanning, for example. In this case, after the printing of the last part of the black image in the forward scanning, the color ink image printing after the paper feeding starts with this part (the final portion of the black image formation in the previous print scanning). For this reason, at either one of the left and right edges of the completed print, the time period from the printing of the black ink onto the print medium and the printing of the color ink thereonto (black-color time difference) is relatively short, and it is relatively long at the other edge. Where the black-color time difference is a small, the black-color bleeding tends to occur. In addition, the lower end of the color ink ejection ejection outlet array b and the upper end of the black ink ejection outlet array portion a (portion c in the Figure) are adjacent to each other in the sub-scan direction (paper feeding direction), and therefore, the color ink and the black ink having the different perviousness and the like are contacted to each other with the result of bleeding occurrence. Additionally, surfactant contained in the color ink, for example, might flow into the black ink with the result of lowering of the interface tension of the black ink, which leads to movement of the black ink. If this occurs, the image density at this portion decreases, does deteriorating the image quality.

SUMMARY OF THE INVENTION

FIG. 2 shows another example of arrangement of the ejection outlet array in which a spacing corresponding to the distance of one sheet feeding operation between the black ejection outlet array and the color ejection outlet array when the color images are formed. In this Figure, as for the black ejection outlet array, only the portion used for the color image formation is shown.

With this structure, the black ink is ejected onto the print medium from the black ejection outlet array in a forward scanning, for example. Then, the paper feeding is carried out, but in the subsequent backward scanning of printing, the ink is not ejected onto this position on the print medium. The paper feeding is further carried out, and in the next forward scanning, the color ink is printed onto this position, thus completing the printing of one printing region. In this system, there is a time difference corresponding to one print scanning from the black ink shot to the color ink shot. This is advantageous over the arrangement shown in FIG. 1 from the standpoint of preventing the black-color bleeding. It is considered that at the left and right positions on the print medium, the black-color time differences are equal in one print region, and therefore, this arrangement is advantageous from the standpoint of preventing the deterioration of the image quality.

However, the inventors investigations have revealed a problem with the arrangement shown in FIG. 2, depending on the control of the recording operation.

For example, the black ink is printed on the print medium in the forward scanning, and thereafter, the sheet is fed, and then, the backward print scanning is carried out. To the region on the print medium to which the black ink has just been printed, the color ink is not printed, as described hereinbefore. However, if the color ejection outlet array prints the color ink to form image in another (adjacent) region on the print medium during the backward printing scanning operation, there is a possibility that color ink is shot to the area close to the area to which the black ink has been shot. At either one of left and right ends, the color ink is shot with a short time difference from the shot of the black ink, closely to the black ink shot area. Then, the deterioration of the image quality because of the above-described black-color bleeding and difference in the perviousness between the black ink and color ink, results.

The arrangement of the ejection outlet array shown in FIG. 3, is an example in which the distance between the black ejection outlet array and the color ejection outlet array is slightly larger than the distance of the one paper feeding, as a countermeasure against the problem. According to the arrangement shown in FIG. 3, the problem with the arrangement of FIG. 2 can be avoided.

The printing operation with the arrangement FIG. 3 will be described. The relative to positional relationship between the image formed on the print medium by the black ejection outlet array and the printing head is shown in (1), and then, the sheet is fed, by which the positional relationship is as indicated by (2). With disposition of relationship, the subsequent print scanning operation is carried out. As will be understood from the Figure, even if the color ejection outlet arrays eject the ink on the print medium, the ink is not overlaid or is not close to the position of the image previously printed.

When the sheet is further fed, the positional relationship becomes as shown in (3), which is the position where the first black ink is printed. In the subsequent print scanning apparatus, the color ink is ejected for a hatched region d. The sheet is further fed, and the relative to position becomes as indicated by (4), which is the position of the first black ink printing. Then, the color ink is ejected to the hatched region e, by which the image printing is completed for the one printing area.

However, it has been found that with this arrangement, there still remains a problem. As for the region d on the print medium, the black ink is ejected, and then one scanning operation is carried out without ejection of the ink, and then the color ink is ejected. On the other hand, as of the region e in the Figure, the black ink is ejected, and the color ink is ejected after two scanning operations without ejection of the ink. Therefore, the same period from the ejection of the black ink onto the print medium to the ejection of the color ink is not uniform, and this would result in band-like non-uniformity appearing in the image. The problems arising in the recording operations with the arrangements for FIGS. 2, 3 are small decrease of the image quality. However, in the case of the recording device with which a high image quality is desired, the problem is to be solved.

As a modification of the arrangement of FIG. 3, it would be considered that distance between the black ejection outlet array and the color ejection outlet array is extended to that corresponding to two printing scans or more. However, if this is done, the size of the printing head becomes bulky, and the cost of the printing head rises. Additionally, it becomes difficult to provide a uniform fine gap between the printing head and the print medium.

The inventors have confirmed through experiments that deteriorations of the image quality attributable to the difference in the pervious between the black ink and the color ink and to the black-color bleeding, tended to occur where a relatively large amount of black ink is printed onto the print medium, and the ink dots are continuous on the print medium. The deteriorations of the image quality attributable to the difference in the fixing state and the penetration of the ink due to the difference, depending on the areas on the print medium, in the time difference from the shot of the black ink to the shot of the color ink, tend to occur where a relatively small amount of black ink is ejected onto the print medium, and the black ink dots are not yet continuous. It has also be found that phenomena are significantly influenced by the amount of the color ink.

Accordingly, it is a principal object of the present invention to provide a solution to at least one of the above-described problems, wherein proper print controlling modes are selected depending on the image data to be printed.

According to an aspect of the present invention, there is provided an ink jet printing apparatus comprising print means having a polarity of ejection outlet arrays each having a plurality of ejection outlets, arranged in a predetermined direction, for ejecting ink, scanning means for scanningly moving said print means relative to the print medium in a main scan direction which is different from the predetermined direction during a printing operation, and means for feeding the print medium relative to said print means in a direction which is different from the main scan direction, wherein an image is formed on the print medium while repeating scanning operation of said scanning means and feeding operation by said feeding means, comprising: information obtain means for obtaining image information corresponding to at least one of said ejection outlet arrays with respect to a predetermined area of image data to be printed; and selecting means for selecting such a portion in said at least one of ejection outlet arrays as is to effect printing for the image data in the predetermined area, on the basis of the information obtained by said information obtaining means upon image formations.

According to another aspect of the present invention, there is provided an ink jet printing method comprising a step of preparing print means having a polarity of ejection outlet arrays each having a plurality of ejection outlets, arranged in a predetermined direction, for ejecting ink, a step of scanningly moving said print means relative to the print medium in a main scan direction which is different from the predetermined direction during a printing operation, and a step of feeding the print medium relative to said print means in a direction which is different from the main scan direction, wherein an image is formed on the print medium while repeating scanning operation of said scanning step and feeding operation of said feeding step, comprising an information obtaining step of obtaining image information corresponding to at least one of said ejection outlet arrays with respect to a predetermined area of image data to be printed; and a selecting step of selecting such a portion in said at least one of ejection outlet arrays as is to effect printing for the image data in the predetermined area, on the basis of the information obtained by said information obtaining step upon image formations; and a step of forming an image with a portion in the ejection outlet array selected by said selection step.

According to the present invention, there is provided a printing apparatus wherein an image is formed on a print medium using at least two ejection outlet arrays which are disposed with deviation in the print medium feeding direction and in the scanning direction which is perpendicular to the feeding direction, said apparatus comprising means enabling image formations using a plurality of portions in one ejection outlet array for image data of a predetermined area, wherein the print data assigned to the plurality of portions are changed on the basis of the image data of the predetermined area containing the image data. In other words, the image data is checked for each of predetermined areas, and the advantageous print control more being selected so that expected deterioration of the image quality is avoided.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 12 illustrates a table used in the third embodiment of the present invention.

DESCRIPTION OF THE PREFERRED EMBODIMENTS

The description will be made as to the embodiments of the present invention in conjunction with the accompaniment drawings.

In this specification, "print" ("recording") means formation or processing of a print medium by forming an image, a pattern or the like, widely including a character, a letter, a Figure or the like, by applying liquid onto the print medium, irrespective of weather or not it is of meaning and the respective of whether or not it is visualized to be sensed by human beings. In this specification, "deterioration of image quality" includes deterioration of the processing accuracy in the case of processing.

In this specification, "print" or "recording" includes formation, on a recording material, of significant or non-significant information such as an image, a pattern, character, figure and the like, and processing of a material on the basis of such information, visualized or non-visualized manner.

Here, the "recording or printing material" includes paper used in a normal printer, textile, plastic resin material, film material, metal plate and the like which can receive ink ejected from the print head. It may simply be called "paper" or "sheet", hereinafter.

Here, "ink" or "liquid" includes liquid usable with the "print" or "recording" defined above, and liquid usable to formation of an image, patter or the like on the printing material or to processing of the printing material.

(1) First Embodiment (1.1) An Example of Printing Apparatus

Figure 4:
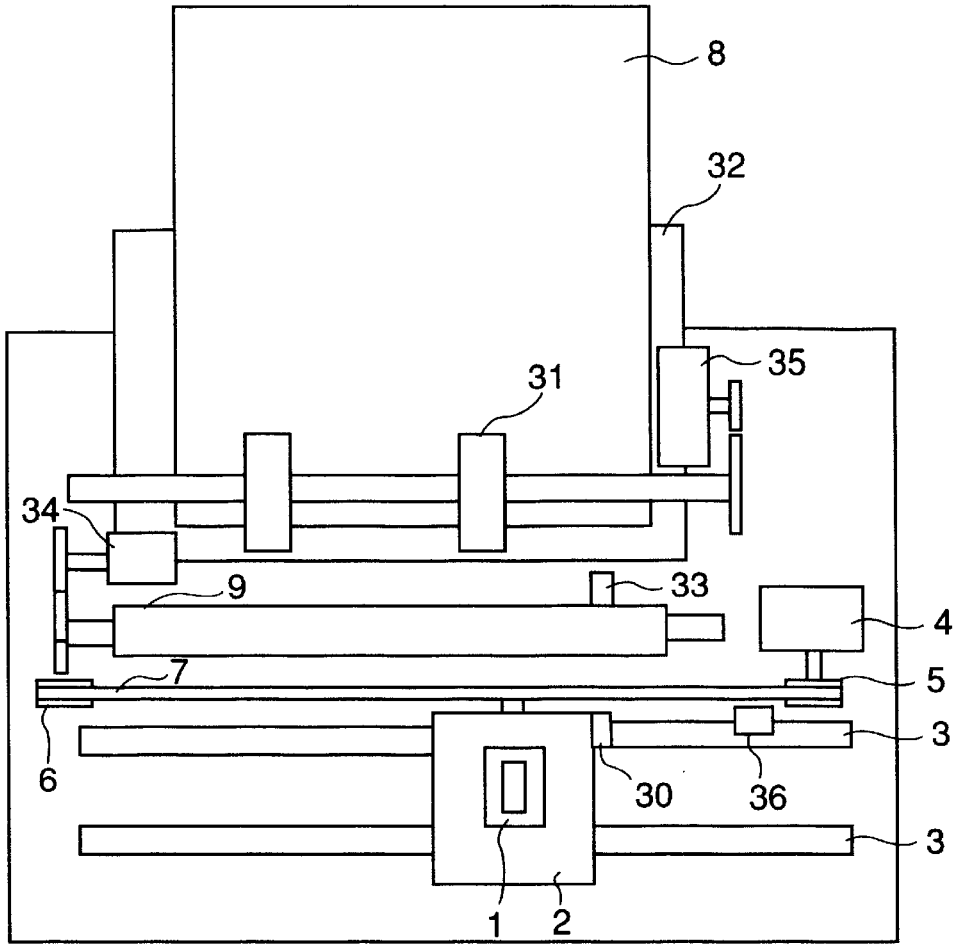
FIG. 4 is a schematic perspective view of an ink jet printing apparatus to which an embodiment of the present invention is applicable.

FIG. 4 is a schematic perspective view of an example of an ink jet printing apparatus to which the present invention is applicable.

As shown in FIG. 4, a head cartridge 1 is removably mounted on a carriage 2. The head cartridge 1 comprises a printing head portion for ejecting the ink and an ink container portion for accommodating the ink. The head cartridge 1 is provided with a connector for sending and receiving signals for driving the head portion.

The head cartridge 1 is carried on a carriage 2 at a correct position. The carriage 2 is further provided with a connector holder (electrical connecting portion) for transmitting driving signal or the like to the head cartridge 1 through the connector.

The carriage 2 is reciprocally supported and guided by a guiding shaft 3 provided in the main assembly of apparatus, the guiding shaft 3 extending in a main scan direction. The carriage 2 is driven by a main-scanning motor 4 through a transmission movement mechanism including a motor pulley 5, a follow pulley 6, a timing belt 7 or the like, and the movement and position in the main scan direction is controlled. Designated by a reference numeral 30 is a sensor for detecting a reference position (home position) in the main scan connection of the head cartridge 1 or the carriage 2.

The rotation of the sheet feeding motor 35 is transmitted to a pick-up roller 31 through a gear so that it is rotated, by which the print paper, thin plastic resin plate or another print medium 8 is separated from an automatic sheet feeder (ASF) 32. By the rotation of the feeding roller 9, the recording material is fed through a position where the head cartridge 1 and the ink ejection outlet of the printing head are opposed to each other. The feeding roller 9 is driven by transmitting the rotation of the line feed (LF) through a gear. At the time when the paper end sensor 33 detects the passage of the print medium 8, the discrimination is made as to whether or not the sheet has been fed, the leading-edge position of the sheet is determined. Furthermore, the rear end of the print medium 8 is detected, and the paper end sensor 33 is used to determine the current print position from the actual trailing edge position.

The print medium 8 is supported by a platen (unshown) at its back side such that flat surface to be printed is established. The head cartridge 1 carried on the carriage 2 is supported such that surface having the ejection outlets (ejection side surface) which are extended downwardly from the carriage 2 portion is parallel to the print medium 8.

The head cartridge 1 has a print portion which ejects the ink using thermal energy, for example, and the print portion has electrothermal transducers for generating thermal energy in response to electric energization. The print portion used in the head cartridge 1 according to this embodiment generates film boiling in the ink by the thermal energy applied by the electrothermal transducer, and the pressure of a bubble generation ed thereby is effective to eject the ink through the ejection outlet, thus effecting the printing.

Figure 5:
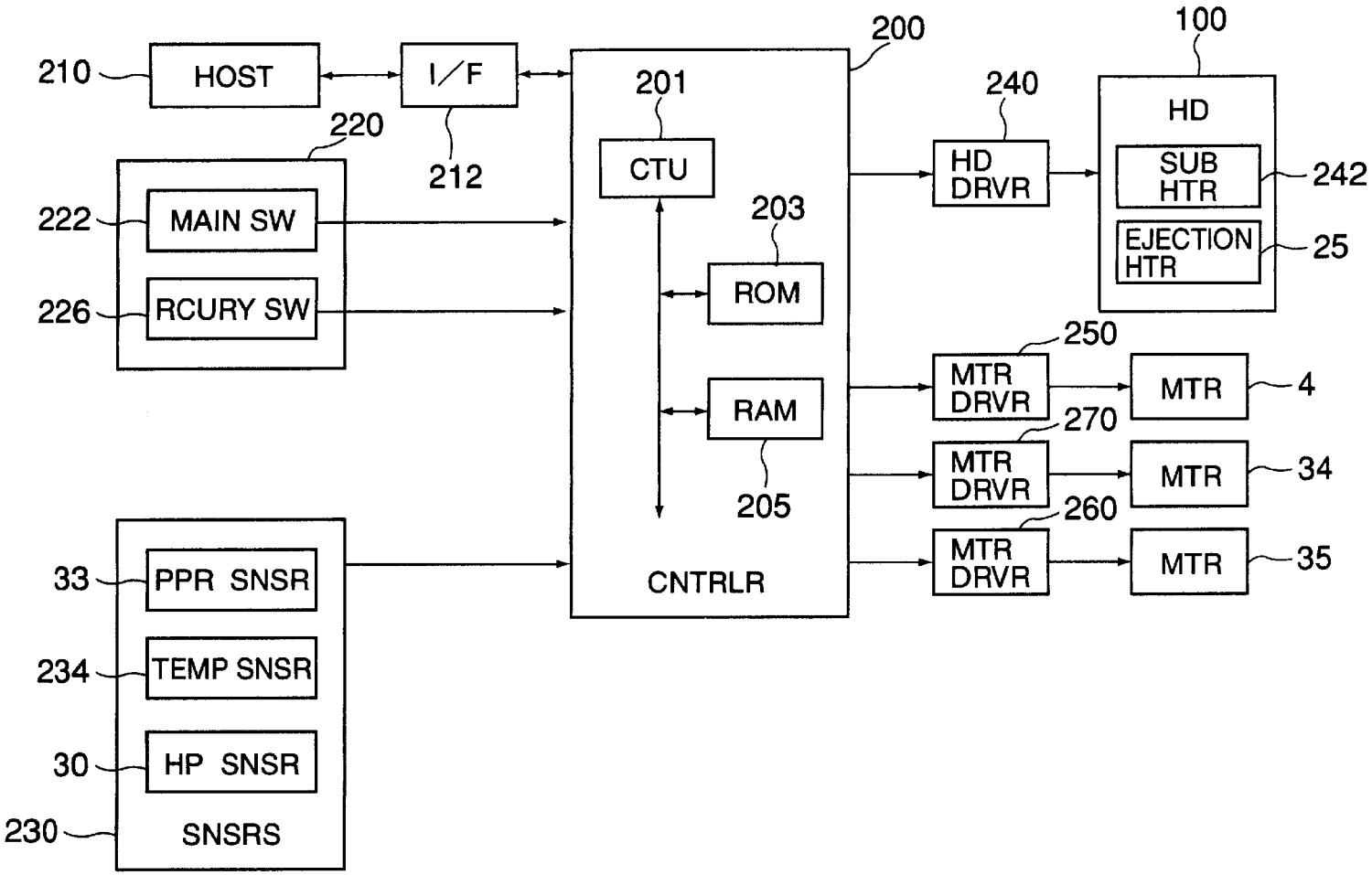
FIG. 5 is a block diagram of a control circuit used in the ink jet printing apparatus shown in FIG. 4.

FIG. 5 is a block diagram showing an example of a structure of the control circuit in the ink jet printing apparatus of FIG. 4.

In FIG. 5, a controller 200 constitutes a main controller, and comprises, for example, a CPU 201 in the form of a micro computer, a ROM 203 containing the program and a predetermined table, RAM 205 having an area for conversion and a working area. The host apparatus 210 is a supply source of image data and may be a computer for effecting generation of data, processing or the like, or a reader portion for reading an image, or a digital camera or the like. The image data, commands, status signals or the like are sent or received between the controller 200 through an interface I/F 212.

The operating portion 220 has a group of switches for inputting instructions by the user and includes a main switch 222, a recovery switch 226 for initiating a refreshing process for maintaining proper ink ejection.

Designated by 230 is a group of sensors for detecting states of the apparatus, which includes a home position sensor 30 for detecting a home position in the direction of the main scan of the printing and, a paper end sensor 33 for detecting presence or absence of the print medium or the like, a temperature sensor 234, disposed at a proper position, for detecting an ambient temperature, and so on.

Designated by 240 a driver for driving an electrothermal transducer (ejection heater) for the printing head 100 in accordance with the print data or the like. The head driver 240 comprises a shift register for aligning the print data correspondingly to the position of the ejection heater 25, a latching circuit for latching the aligned data at proper timing, a logic circuit element for actuating the ejection heater in synchronism with the actuation timing signal, a timing setting portion for setting proper drive timing (ejection timing) for alignment for the dot formation.

The printing head 100 is provided with a sub-heater 242 in addition to the ejection heater 25. The sub-heater 242 functions for temperature adjustment to stabilize the ejection of the ink, and it may be built into the printing head substrate simultaneously with the ejection heater 25, and/or may be mounted to the main body of the printing head 100 or the head cartridge 1.

Designated by 250 is a motor driver for driving the main-scanning motor 4, and 270 is a motor driver for driving the LF motor 34 for feeding the print medium 8 in the sub-scan direction. Designated by 260 is a driver for driving a sheet feeding motor for separating and feeding the print medium 8 from the ASF.

(1.2) An Example of Print Control

Figure 6:
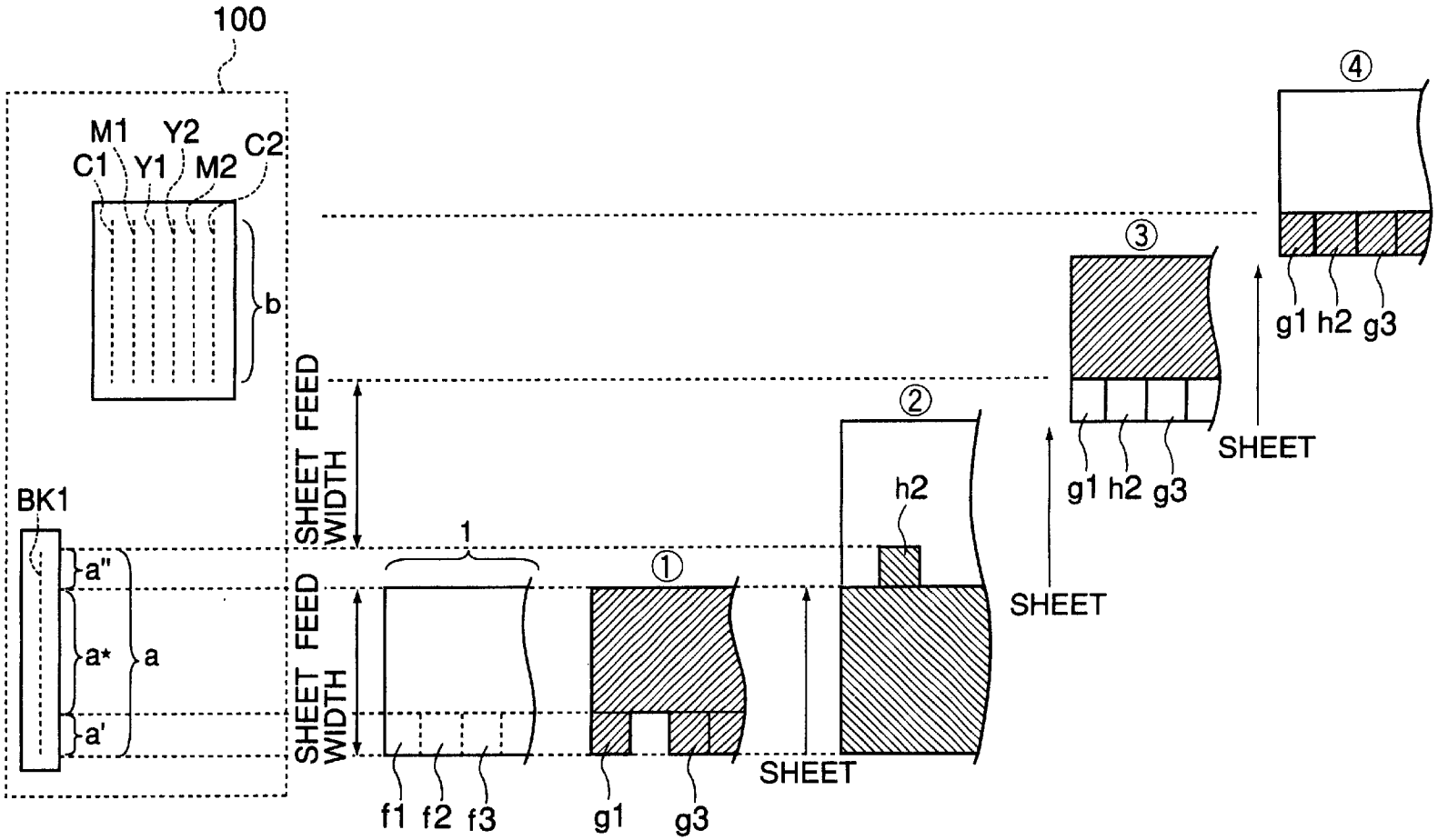
FIG. 6 illustrates a print control in an embodiment of the present invention.

Referring to FIG. 6, the print control according to this embodiment will be described. In the Figure, at the left, arrangements of black ejection outlet array Bk1 and color ejection outlet arrays C1, C2, M1, M2, Y1, Y2 on a surface of the printing head 100 opposed to the print medium 8. In this Figure, the printing head 100 scans along the surface of the sheet in the direction perpendicular to the sheet feeding direction indicated an arrow (left-right direction in the Figure).

In this embodiment, a range b of the color ejection outlet arrays is equal to the length of one to feeding (the feeding width), and a distance between the color ejection outlet arrays and the black ejection outlet array is also equal to the sheet feeding width. The range of the black ejection outlet array Bkl is equal to the sheet feeding width (a* +a +a '=b) plus a length of a predetermined ejection outlet array portion indicated by a" in the Figure, and length of the ejection outlet portion an and the length a" are equal to each other.

Designated by reference numeral 1 in the Figure is quatized black image data to be printed. For each of predetermined areas f1, f2, f3, enclosed by a broken line in the black image data, the dots corresponding to the black data among the image data is counted. The height measured in the sub-scan direction of the area to be counted is equal to a', and the length measured in the main scan direction corresponds to 8 pixels in this embodiment for easy calculation. In this embodiment, in accordance with the dot count for each area, it is selected whether the printing of the black data in the area is to be carried out by the ejection outlet array portion in the range a' or by the ejection outlet array portion in the range a". In the present invention, the region for each dot to be printed on the basis of the image data is treated as a pixel.

Figure 7:
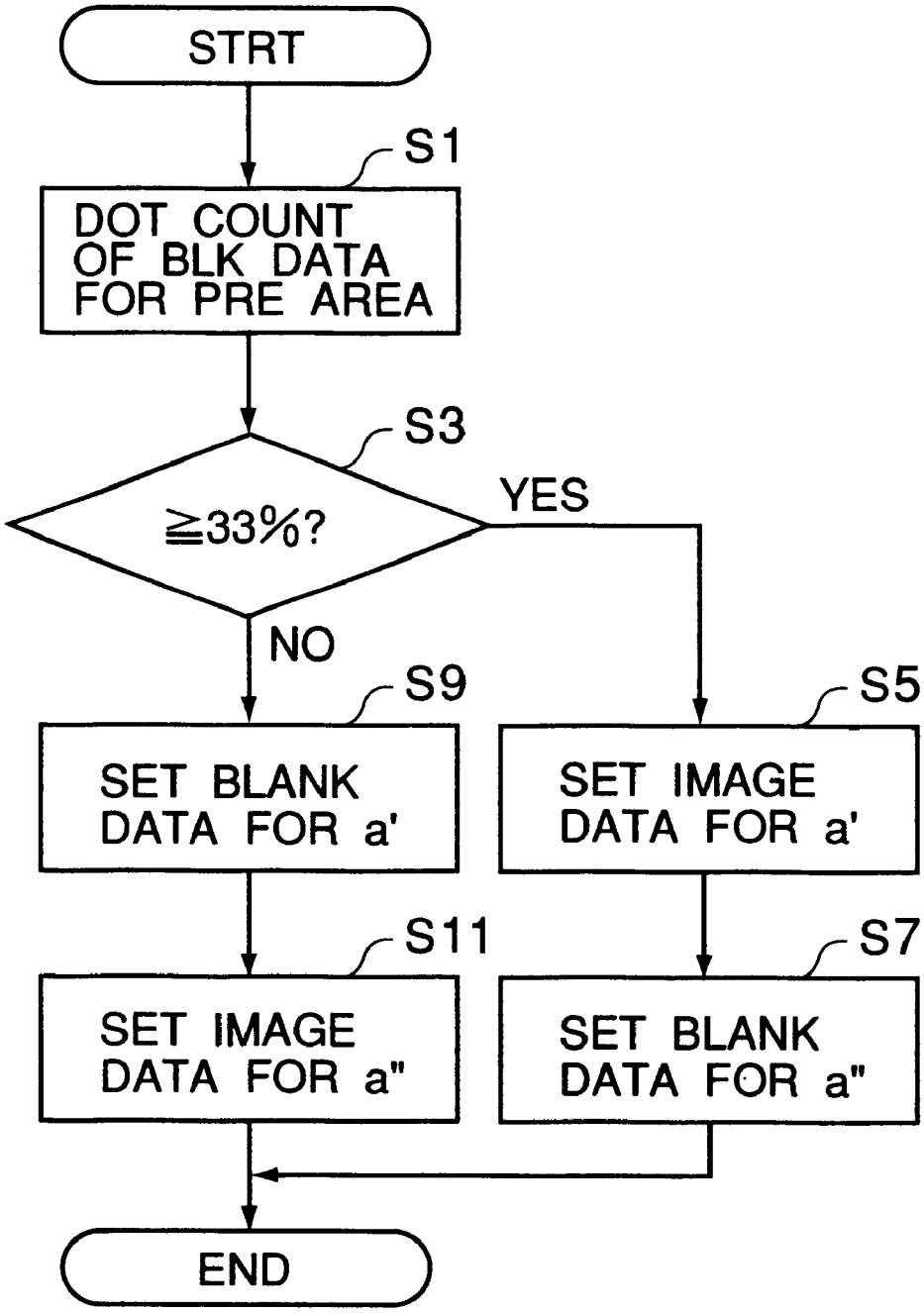
FIG. 7 Is a flow chart of an example of a data setting process steps for an ejection outlet array portion, used in the print control shown in FIG. 7.

FIG. 7 is a flow chart of an example of a setting process steps.

At step S1 in FIG. 7, the dots corresponding to the black data is counted for one of the predetermined areas shown in FIG. 6 (more particularly, the first area is area f1). Then, at step S3, the discrimination is made on the basis of the result of the dot count. Here, 100% means the case in which there are data to be printed in all of the pixels. If the result the dot count is not less than 33% (that is, the percentage of the black data in the image data is relatively high), the image data is so set that image data in the area is printed by the ejection outlet array portion a' (step S5) and the no ejecting operation is carried out by the ejection outlet portion a" (by setting blank data, at step S7). On the other hand, the result of the dot count is less than 33% (that is, the percentage of the black data in the image data is relatively small), the blank data are set for the ejection outlet array portion a' (step S9), and the setting is executed such that image data in the area is printed by the ejection outlet portion a" (step S11).

Such process steps are effective for each of the areas f1, f2, f3, shown in FIG. 6, by which the black data in each area is printed either by ejection outlet array portion a' or a".

Referring to FIG. 6, the description will be made as to the print control on the basis of such settings in terms of the relationships between the printing head and the image formed on the print medium.

It is supposed that result of the dot count indicates that black print data in the area f1 on the image data to be printed is not less than 33%. It is also supposed that for the area f2, it is less than 33%, and that for the area f3, it is again not less than 33%. Then, the image data corresponding to the area f1 and area f3 are set in the memory region for the ejection outlet array a', and blank data are set for the area f2. Similarly, the image data corresponding to the area f2 are set in the memory region for the ejection outlet portion a", and the blank data are set for the area f1 and area f3.

Then, the printing operation is carried out corresponding to the image data set for respective regions. The image data for the area f1 and the area f3 for which the count is not less than 33%, are printed by the ejection outlet array a' in the first print scanning operation. The hatched regions indicated by (1) in FIG. 6 are print regions on the print medium to be printed in the first printing scan, the printing is executed for the parts indicated by g1 and g8 corresponding to the area f1 and the area f3.

Thereafter, the sheet is fed, and the next scanning operation is carried out. The region h2 is printed by the ejection outlet a" corresponding to the area f2 for which the black dot count is less than 33%. The sheet is further fed, and the color printing is carried out in the next printing scan hatched region indicated by (3) in the Figure). Then, the sheet is fed, and the color printing is carried out corresponding to the hatched regions g1, h2, 83 indicated by (4) in the Figure in the subsequent printing scan. Thus, the image is completed for one print region.

Figure 1:
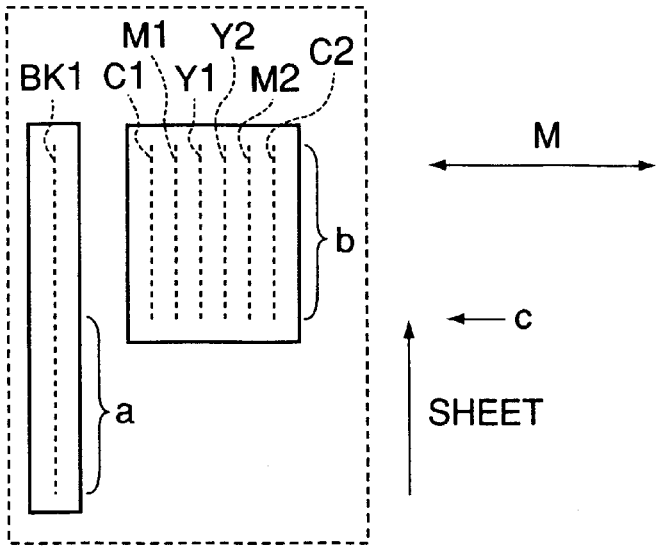
FIG. 1 shows a conventional arrangement of ejection outlet arrays which is used to avoid bleeding between inks having different compositions when the printing is carried out with different kind of inks having different compositions.
Figure 2:
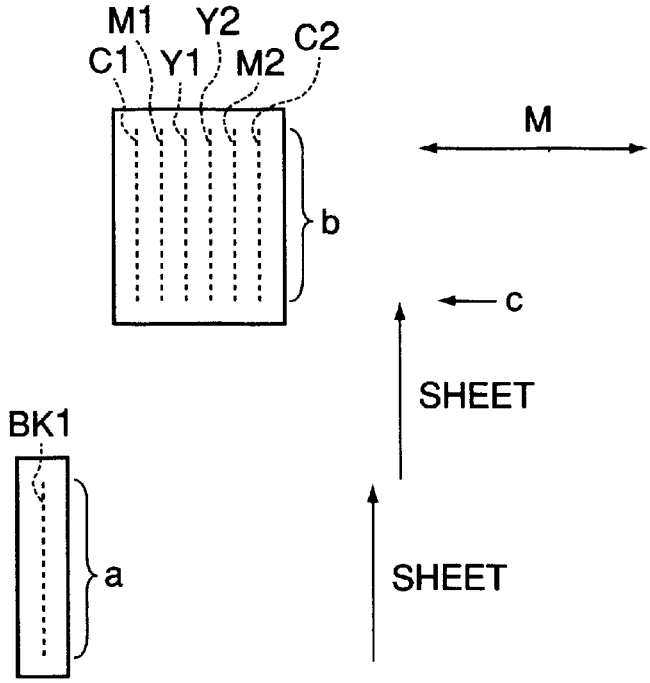
FIG. 2 Shows an arrangement of ejection outlet arrays which is used to avoid deterioration of the image quality attributable to the different, depending on the areas on the print medium, in the differences of time from the shot of the ink having a certain composition to the shot of the ink having a different composition.

Through these process steps, the printing is carried out fundamentally under the equivalent conditions as with the arrangement shown in FIG. 2, for the image data which has a relatively low (less than 33% in this embodiment) black print duty and with which the deterioration of the image quality attributable to the difference, depending on the areas, in the time differences from the shots of the black ink to the shots of the color ink is remarkable, as discussed hereinbefore. In addition, the printing is carried out fundamentally under the equivalent conditions as with the arrangement shown in FIG. 3 because of the use of the printing operation using the ejection outlet array portion of the equivalent arrangement, for the image data which has a relatively high (not less than 33% in this embodiment) black print duty and with which the deterioration of the image quality attributable to the difference in the perviousness between the black ink and the color ink and to the black-color bleeding is dominant. Therefore, the high speed image formation is accomplished with suppressed deteriorations of the image qualities described hereinbefore.

(2) Second Embodiment

Figure 3:
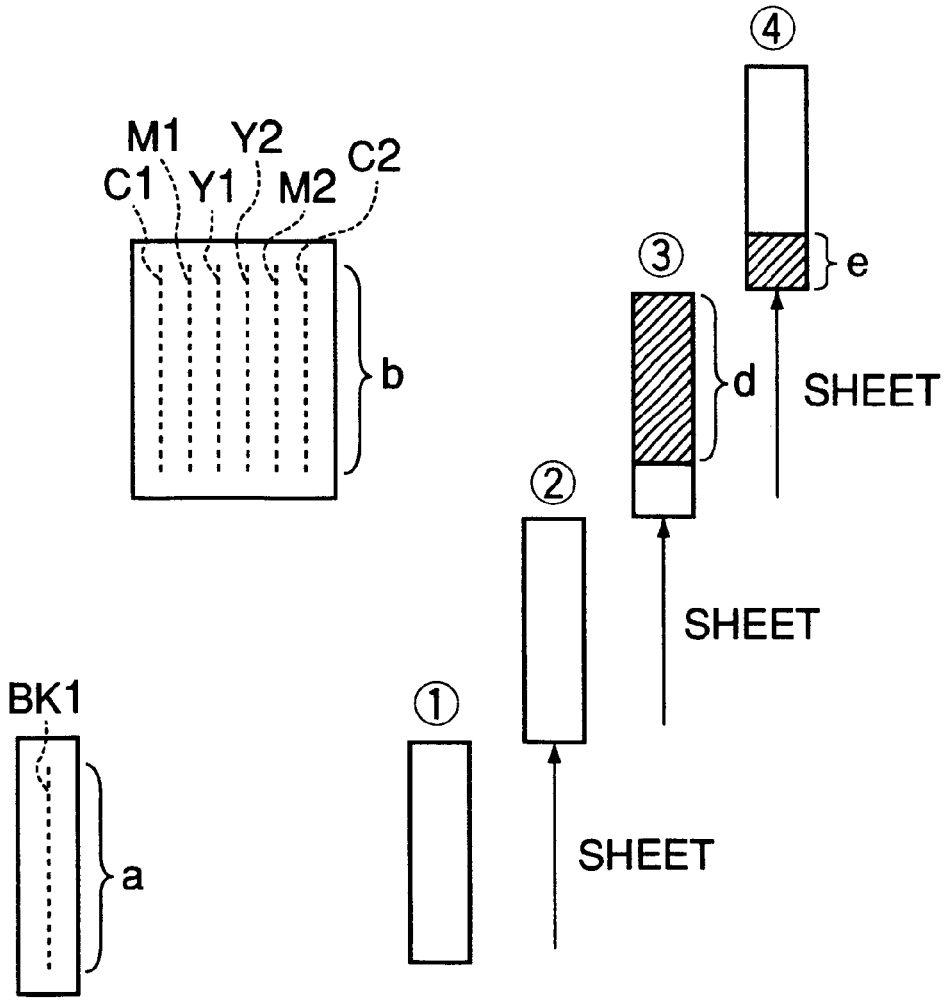
FIG. 3 Shows an arrangement of ejection outlet arrays which is used to avoid deterioration of the image quality attributable to the shortage of the time period from the shot of the ink having a certain composition onto a predetermined print region to the shot of the ink having a different composition onto another print region which is adjacent to the predetermined print region.

Depending on the materials of the print medium and the composition of the ink, there is a possibility that black-color bleeding or the like is produced with the use of the ejection outlet array arrangement shown in FIG. 2 at a boundary between the region in which the black-color bleeding or the like is remarkable and the non-uniformity attributable to the difference, depending on the areas on the print medium, in the black-color time differences, are remarkable, and non-uniformity attributable to the difference, depending on the areas, in the black-color time differences is produced with the use of the ejection outlet array arrangement shown in FIG. 3.

The second embodiment of the present invention with which such a problem can be avoided. Similarly to the foregoing embodiment, the structures to the printing apparatus and the control system of the foregoing embodiment and the arrangement of the ejection outlet array are usable. However, in the print control method for the black data in accordance with the result of the dot count in this embodiment, the selection is made from three choices.

Figure 8:
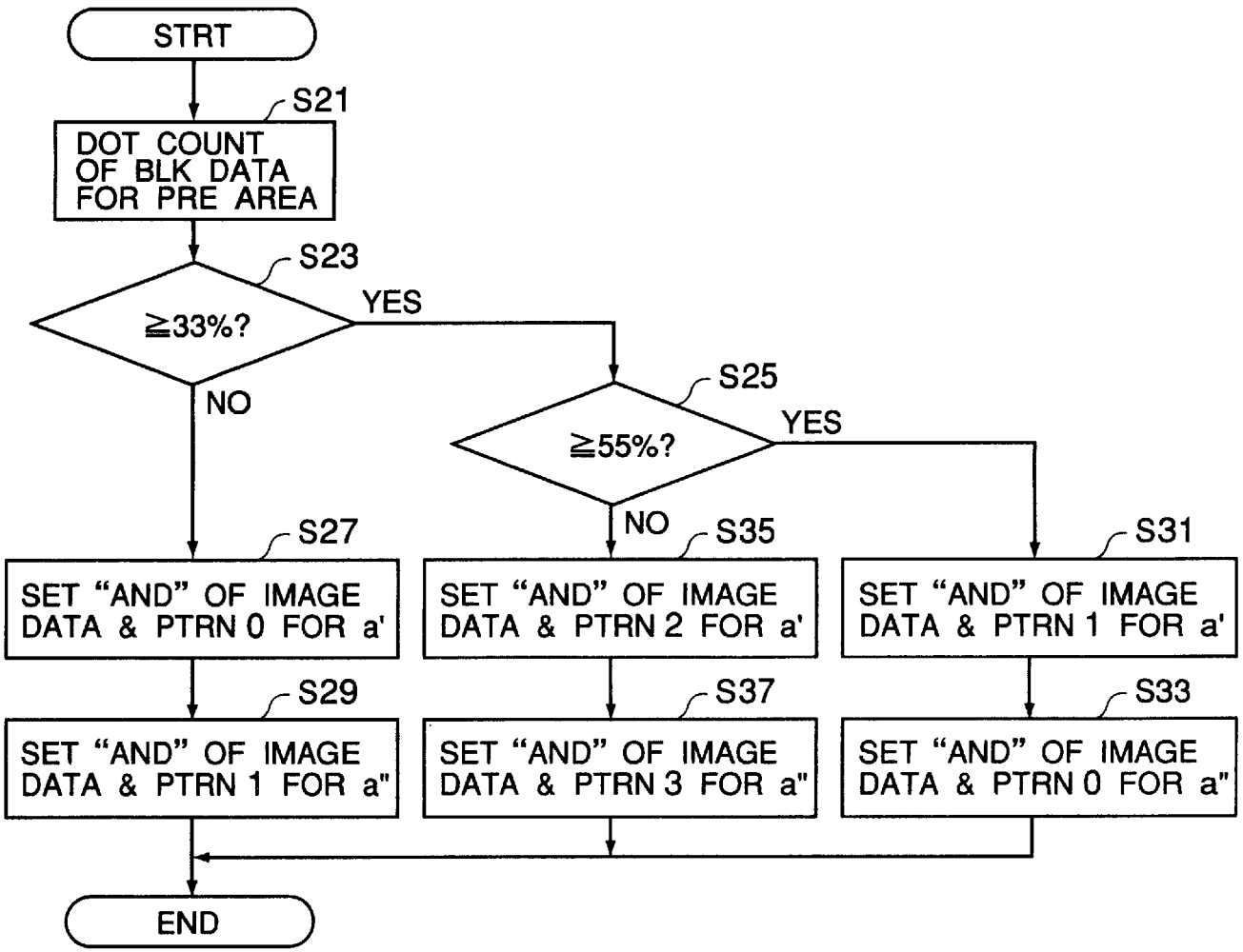
FIG. 8 is a flow chart of an example of a data setting process steps for ejection outlet array portion, used in a print control according to a second embodiment of the present invention.

FIG. 8 is a flow chart according to an example of the setting process steps accomplishing this, and FIGS. 9A–D show an example of a pattern data used in the setting process.

Figure 9A:
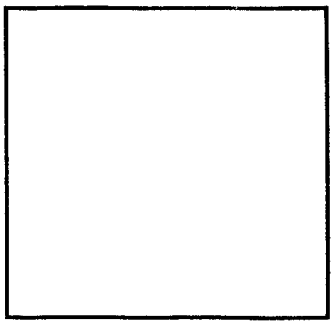
FIGS. 9 (A–D) is a schematic view of examples of pattern data used in the process shown in FIG. 8.
Figure 9B:
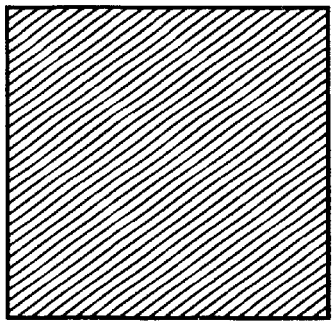

At step S21 in FIG. 8, similarly to the process at step S1 in FIG. 7 in the foregoing embodiment, the black image data dots are counted in a predetermined area, and at step S23, the discrimination is made as to whether or not the count is not less than 33%. If the result of the discrimination is less than 33%, the operation goes to step S27, where the data of logical product (AND) of the image data and "pattern" 0 shown in FIG. 9A are set in the memory region for the ejection outlet array portion a'. Since "pattern 0" is constituted by blank data, as shown in FIG. 9A, the blank data are set in the memory region for the ejection outlet array portion a'. At step S29, data of logical product (AND) of the image data and the pattern 1 shown in FIG. 9B are set for in the memory region for the ejection outlet portion a". The pattern 1 is a full-data patten as shown in FIG. 9, (*b*), and therefore, the image data are set as they are in the memory region even if AND gate is passed. That is, the process equivalent to that in the above-described embodiment in the case of low black duty.

When the result of the dot count indicates not less than 33% at step S23, and not less than 50% at step S25, the operation proceeds to step S31, where the data of logical product (AND) of the image data and the pattern 1 shown in FIG. 9B are set in the memory region, that is, the image data as they are set in the memory region. Subsequently, at step S33, the data of logical product (AND) of the image data and the pattern 0 shown in FIG. 9A are set in the memory region for the ejection outlet portion a", so that blank data are set in the memory region. This process is equivalent to the process of the foregoing embodiment, for the case of the relatively high black duty.

Figure 9C:
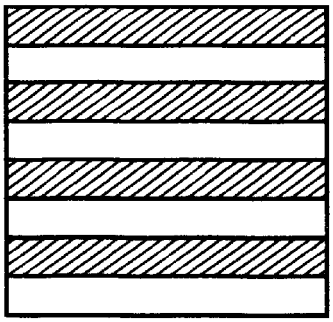
Figure 9D:
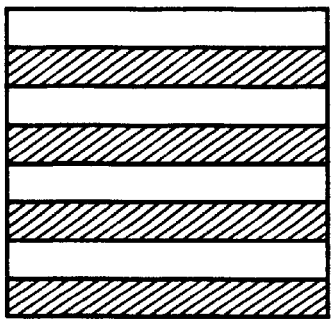

When the result of the dot count indicates not less than 33% less than 50%, the image data is thinned with the pattern 2 shown FIG. 9C and the pattern 3 shown in FIG. 9D, that is, half duty patterns which are in interpolation relationship, and then our set in the memory region for the ejection outlet portion a" and in the memory region for the ejection outlet array portion a', at step S35 and S37.

Through these process steps, the high speed image formation is accomplished while preventing deterioration of the image quality even when the combination of the print medium and the ink is such that black-color bleeding occurs with the ejection outlet array arrangement shown in FIG. 2 and that non-uniformity attributable to the differences, depending on the areas, in the black-color time difference with the ejection outlet array arrangement shown in FIG. 3.

By the processing according to this embodiment, the smooth continuation is accomplished between the portion of print of the image data in the predetermined area only by the ejection outlet array a' and the portion of print of the image data in the predetermined area only by the ejection outlet a".

(3) Third Embodiment

In the third embodiment of the present invention, in addition to the structure employed in the second embodiment, means is provided to change the threshold level for discriminating for selection of the print control mode on the basis of the result of the dot count for the black, in accordance with the information of the ink ejection amount from the black ejection outlet array or the information relating thereto. When a high duty image is formed only by the black ink, there is a deterioration of image quality peculiar to that case. This embodiment provides a solution to such a deterioration.

Figure 10:
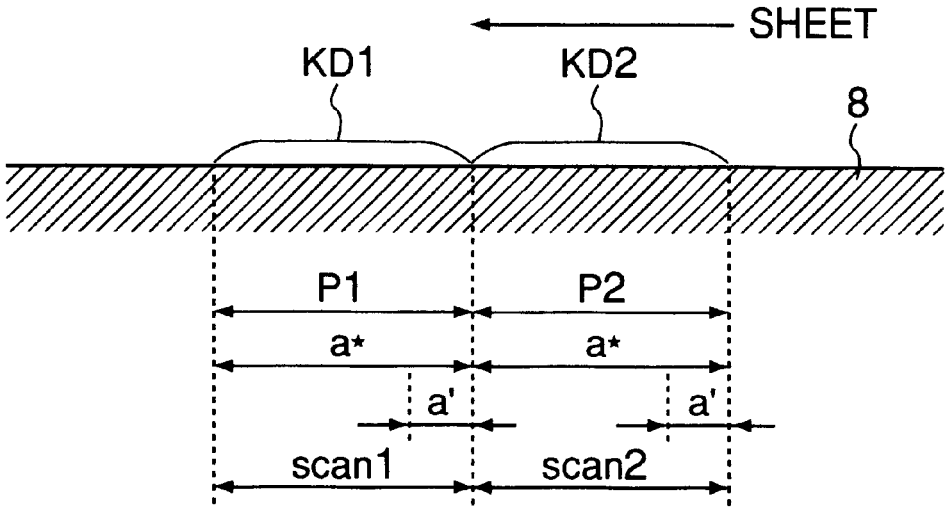
FIG. 10 is an illustration of deterioration of the image quality appearing when a high duty image is formed with black ink alone.

FIG. 10 illustrates the deterioration of the image quality which remarkably appears when the high duty image is formed only by the black ink.

This Figure is a view of a section of the print medium 8 as seen in a direction perpendicular to the sheet feeding direction. In this Figure, designated by KD1 is a state of the ink printed for a print region P1 on the print medium with a prior print scanning scan 1 when the black ink is ejected at a high duty, and KD2 is a state of the ink printed for a next print region P2 with the subsequent print scanning scan 2 after the sheet feeding. As shown in FIG. 10, there is a portion where the thickness of the ink placed on the print medium is small, at a boundary portion between the first printed portion KD1 and the subsequently printed portion KD2 (an adjacent print region). The thin portion exhibits a relatively low density as compared with the portions around it, and therefore, the quality of the printed image is deteriorated. The phenomenon is particularly remarkable in the case of the image formed with the black ink which provides a high reflected optical density.

Therefore, in this embodiment, when the result of the black dot count is larger than a predetermined level, the image is formed using both of the ejection outlet array portion a' and the ejection outlet array portion a' which print the boundary portion between the adjacent print region, by which the thin black ink portion is reduced, thus preventing or suppressing the decrease of the image density.

Figure 11:
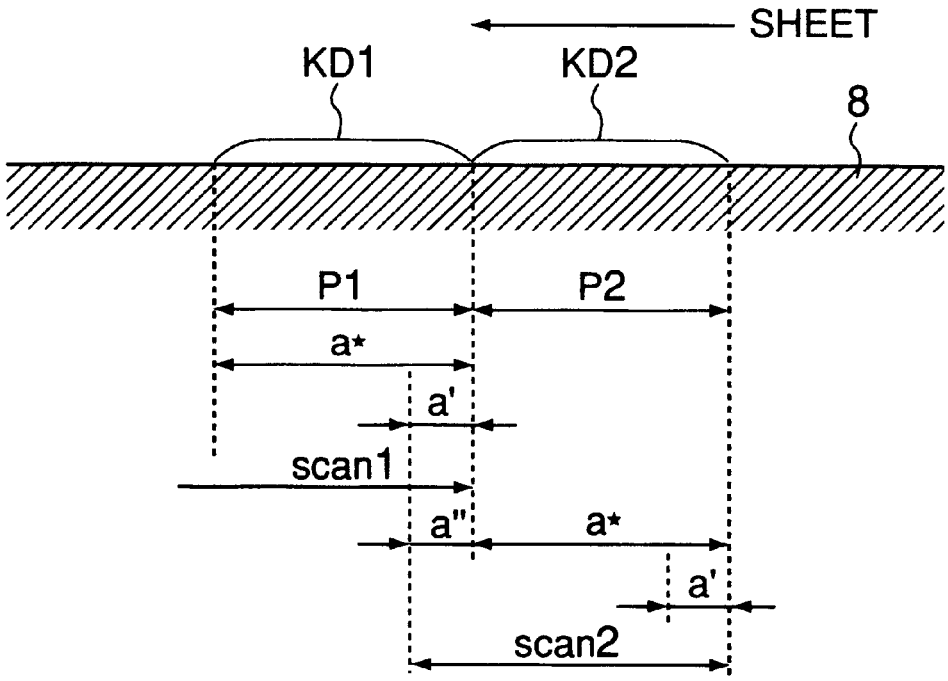
FIG. 11 is an illustration of a print control according to a third embodiment of the present invention.

FIG. 11 illustrates a print control for such process. In this example, among the print region P1 in the range a* to be printed in the prior print scanning scan 1, a half, for example, of the data to be printed by the ejection outlet array portion a' located at the position of the portion adjacent to the print region P2 to be printed by the subsequent print scanning scan2, are printed, and in the subsequent print scanning scan2, the remaining half of the data are printed by the ejection outlet portion a" simultaneously with the printing for the print region P2 in the range a*. By doing so, the ink dots printed simultaneously on the boundary portion of the adjacent print region are combined with each other, and therefore, the thickness of being at the boundary portion between the KD1 and KD2 is not so thin as in the case of FIG. 10.

In the printing apparatus of the embodiment, when the percentage of the black data in the predetermined area is larger than 90%, it is deemed that printing is carried out only with the black ink. In the case of such a high duty black image formation, the above-described method is used since otherwise there is a liability of deterioration of the image quality. More specifically, when the result of the black dot count indicates the percentage one on 90%, the image printing is carried out using both of the ejection outlet array portion a' and ejection outlet portion a".

In this embodiment, a control is effected to suppress the influence of the change of the ejection amount of the black ink due to the ambient temperature under which the printing apparatus is placed and the influence of the variations of the ejection amount of the black ink due to the variations in the manufacturing of the printing heads. More particularly, the threshold level for the selection of the print controlling mode on the basis of the result of the black dot count, in accordance with the head rank set corresponding to the ejection outlet array for the black ink in the manufacturing of the printing head and in accordance with the ambient temperature measured by a temperature sensor 234 (FIG. 5) contained in the printing apparatus.

FIG. 12 is a table for the selection of the threshold level, and the Table may be stored in a ROM 203 or the like as fixed data. In the show an example, the ambient temperature is divided into a case of lower than 20° C., a case of 20° C. or higher and lower than 30° C. and a case 30° C. or higher (three cases). As for the head rank, there are provided three ranks, namely, "1", "0" and "−1". Corresponding to combinations of the ambient temperatures and the head ranks, the threshold level is selected from predetermined three threshold value 1, value 2 and value 3, and the printing mode or method for the black data is selected in accordance with the result half the black dot count.

Figure 13:
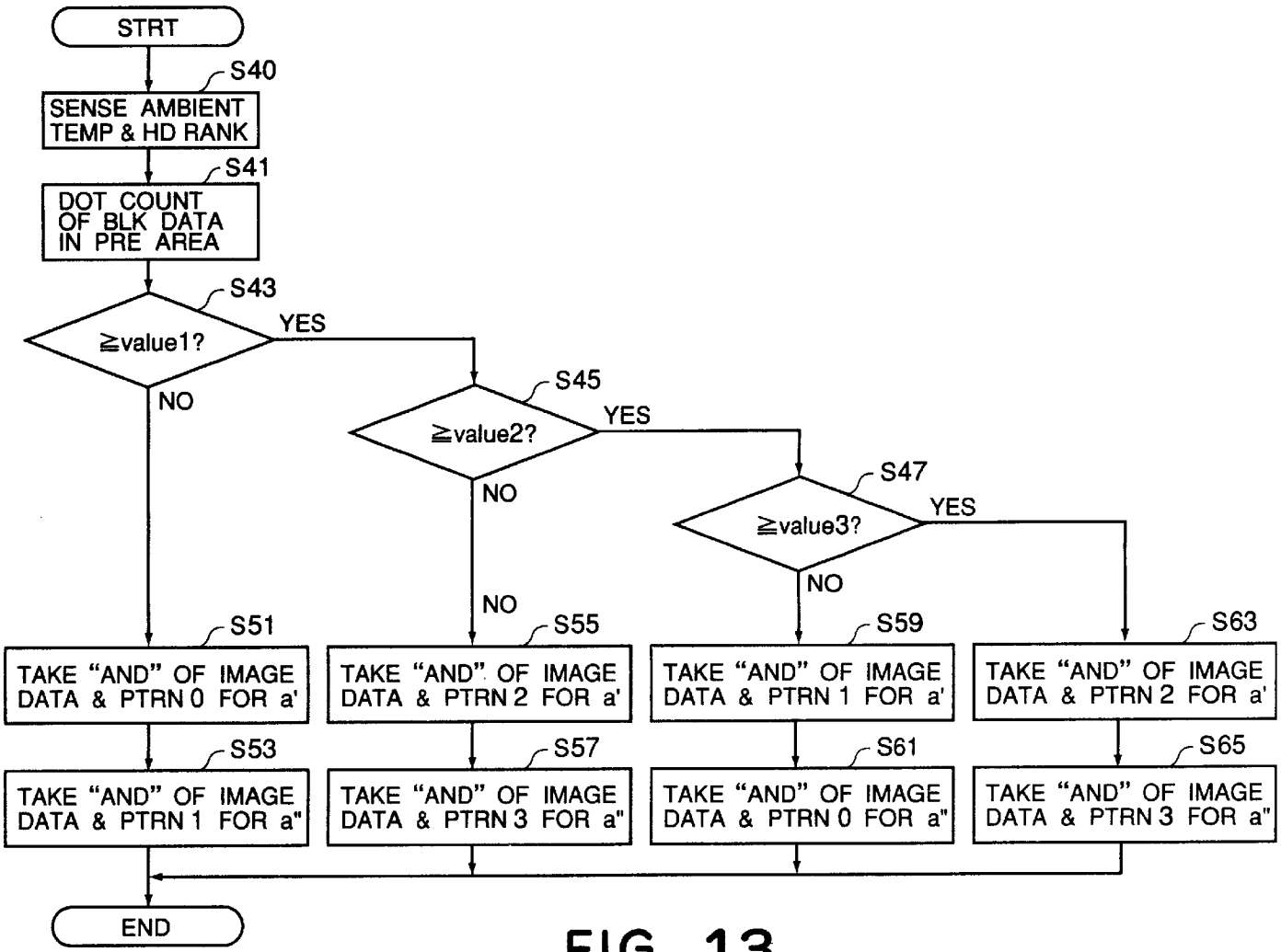
FIG. 13 is a flow chart of an example of a data setting process steps for ejection outlet array portion, used in a print control according to a third embodiment of the present invention.

FIG. 13 is a flow chart of an example of setting process steps for this purpose.

In this example, at step S40, the ambient temperature and the head rank are fetched, and the table to be referred to is determined. Then, at step s41, the dot count for the black image data in the predetermined area is carried out, and at step S43, the discrimination is made as to whether or not the result is larger than the value 1 set in the table to be referred to, for example, as to whether or not it is larger than value 1=35 when the ambient temperature is lower than 20° C., and the head rank is "0".

If the result of the black dot count is not more than value 1, the operation proceeds to step S51, data of AND of the image data and the pattern 0 shown in FIG. 9A are set in the memory region for the ejection outlet array portion a'. Since "pattern 0" is constituted by blank data, as shown in FIG. 9A, the blank data are set in the memory region for the ejection outlet array portion a'. At step S53, data of logical product (AND) of the image data and the pattern 1 shown in FIG. 9B are set for in the memory region for the ejection outlet portion a". The pattern 1 is a full-data pattern as shown in FIG. 9, (*b*), and therefore, the image data are set as they are in the memory region even if AND gate is passed. Therefore, the image of the adjacent portion is printed by the ejection outlet portion a".

When the result of the black dot count indicates that it is larger than value 1, and the discrimination at the step S45 results in not more than value 2, the operation proceeds to steps S55, S57, where the image data is thinned with the pattern 2 shown in FIG. 9C and the pattern 3 shown in FIG. 9D, namely the half duty patterns which are in an interpolation relationship with each other, and are set in the memory region for the ejection outlet portion a" and in the memory region for the ejection outlet array portion a'. Therefore, in this case, the image of the adjacent portion is formed using both of the ejection outlet portion a" and the ejection outlet portion a".

When the result of the black dot count indicates that it is larger than value 2, and the discrimination at the step S47 indicates not more than value 3, the operation proceeds to step s59, where the date of AND of the image data and the pattern 1 shown in FIG. 9B are set in the memory region for the ejection outlet array portion a', so that image data as they are are set in the memory region. Subsequently, at step S61, the data of logical product (AND) of the image data and the pattern 0 shown in FIG. 9A are set in the memory region for the ejection outlet portion a", so that blank data are set in the memory region. Therefore, in this case, the image at the adjacent portion is formed by the ejection outlet array portion a'.

When the result of the black dot count indicates that count is larger than value 3, the operation proceeds to steps S63, S65, and the image data are thinned by the pattern 2 shown FIG. 9C and the pattern 3 shown in FIG. 9D, namely the half duty pattern which are in an interpolating relationship with each other, and are set in the memory region for the ejection outlet array portion a' and in the memory region for the ejection outlet portion a". Therefore, in this case, the image at the adjacent portion is formed using the ejection outlet portion a" and the ejection outlet portion a", so that above-described deterioration of the image quality at the time of high duty black image formation can be suppressed or prevented.

In this embodiment, the threshold level for the discrimination is changeable corresponding to the head rank and/or the variations of the black ink ejection amounts resulting from the change in the ambient temperature, so that switching point of the print control method or mode can be set with a higher accuracy.

In this embodiment, the corrections are carried out for both of the black head rank and the ambient temperature, but the present invention is not limited to this. The threshold for the discrimination may be changed on the basis of either one of them. Another parameters such as a temperature of the printing head per se or another may be used, if it is reflected in the ejection amount of the black ink.

(Other Embodiments)

In the foregoing Embodiments, the black ejection outlet array and the color ejection outlet array are disposed with deviation in the sheet feeding direction. But, this is not limiting. As described in the foregoing, the present invention is effective to accomplish a high speed image formations with suppressed deterioration of the image quality, indicates that above-described deteriorations of the image quality due to various causes in an ink jet printing apparatus using a polarity of ejection outlet arrays which are disposed with deviation in the sub-scan direction, irrespective of whether they are provided integrally in a printing head or whether they are provided in separate printing heads.

In the foregoing, the black ink and the color (cyan, magenta and yellow) ink, but the combination of color tones (including color and density) is not limited to this, if the above-described deterioration of image quality arises.

In the foregoing Embodiments, the black ink is first printed, and then the color ink is printed in the same print region, but the present intention is not limited to such a structure. In other words, the present invention is applicable to an ink jet printing apparatus in which the color ink is first printed.

In addition, in the foregoing embodiments, the printing by a plurality of ejection outlet array portions as to the black ejection outlet array, but the present intention is not limited to this. In other words, the similar structures and controls may be employed for the color ejection outlet array or arrays, by which the deterioration of the image quality due to various factors can be suppressed.

In addition, in the foregoing Embodiments, the control operations are carried out with respective only to the duty of the black image data in terms of the color tones, it is a possible alternative that with respect to the relationship with the duty of the color image data, the print control may be properly selected for the black image data and/or color image data. As regards the values for the print control selection, it may be set or may be variable.

The values in the foregoing embodiments are only examples, and not limiting to the present invention.

The present invention is applicable not only to the ink jet head having an electrothermal transducers as the print elements, but also to the ink jet head having electrical machine conversion members such as piezoelectric element.

As described in the foregoing, according to the present invention, when the printing is effected using different inks having different compositions, proper print controls can be selected in accordance with the image data which determine the amounts of inks to be shot onto the print medium, and therefore the deterioration of image quality attributable to the differences, depending on the areas on the print medium, in the time differences from a shot of the ink having a certain composition to a short of the having a different composition, and/or the deterioration of the image quality attributable to the differences in the pervious between inks or bleeding between the inks having different compositions, can be avoided, and a high speed image formation is accomplished.

While the invention has been described with reference to the structures disclosed herein, it is not confined to the details set forth and this application is intended to cover such modifications or changes as may come within the purpose of the improvements or the scope of the following claims.

What is claimed is:

1. An ink jet printing apparatus comprising:

print means having a plurality of ejection outlet arrays, each having a plurality of ejection outlets, arranged in a predetermined direction, for ejecting ink;

scanning means for moving said print means relative to the print medium in a main scan direction, which is different from the predetermined direction, during a printing operation;

feeding means for feeding the print medium relative to said print means in a direction which is different from the main scan direction, wherein an image is formed on the print medium while repeating a scanning operation of said scanning means and a feeding operation by said feeding means, and wherein one of said ejection outlet arrays extends over a wider range than another one of said ejection outlet arrays in the predetermined direction;

information obtaining means for obtaining image information corresponding to at least one of said ejection outlet arrays with respect to a predetermined area of image data to be printed in a prior scan, which predetermined area corresponds to a portion adjacent to a region to be printed in a later scan; and selecting means for selecting a portion in said at least one of ejection outlet arrays to effect printing for the image data in the predetermined area, on the basis of the information obtained by said information obtaining means about image formations, wherein said selecting means is effective to select use or non-use of opposite end portions of a range to be used for recording by said at least one of ejection outlet arrays, on the basis of the information obtained by said information obtaining means.

2. An apparatus according to claim 1, wherein said information obtaining means obtains the information which relates to an amount of the image data corresponding to single ejections from the ejection outlets in said at least one of ejection outlet arrays, for the predetermined area.

3. An apparatus according to claim 1, wherein said at least one of ejection outlet arrays has ejection outlets arranged over a range larger than a distance through which said sheet feeding means feeds the print medium by one feeding operation, and wherein said selecting means selects at least one portion of said ejection outlet array having the ejection outlets arranged over a range larger than the distance.

4. An apparatus according to claim 1, wherein said at least one of ejection outlet arrays and another one of said ejection outlet arrays are disposed with deviation in a scanning direction of said scanning means and with deviation in the feeding direction through a distance of 1 feeding operation of said feeding means.

5. An apparatus according to claim 1, wherein said ejection outlet arrays are for ejecting different inks having different compositions.

6. An apparatus according to claim 3, wherein said selecting means selects a downstream portion in said at least one of ejection outlet arrays with respect to the sheet feeding direction when an amount of the image data corresponding to said at least one of ejection outlet arrays for the predetermined area is relatively small, and selects an upstream portion in said at least one of ejection outlet arrays with respect to the sheet feeding direction when the amount of the image data corresponding to said at least one of ejection outlet arrays for the predetermined area is relatively large.

7. An apparatus according to claim 3, wherein said selecting means selects a downstream portion in said at least one of ejection outlet arrays with respect to the sheet feeding direction when an amount of the image data corresponding to said at least one of ejection outlet arrays for the predetermined area is relatively small, and selects an upstream portion in said at least one of ejection outlet arrays with respect to the sheet feeding direction when the amount of the image data corresponding to said at least one of ejection outlet arrays for the predetermined area is relatively large, and wherein when the amount of the image data is medium, said selecting means selects both the downstream portion and the upstream portion, and a complementary printing is carried out.

8. An apparatus according to claim 7, wherein when the image data corresponding to said at least one of ejection outlet arrays occupy substantially and the entirety of the predetermined area, said selecting means selects both the downstream portion and the upstream portion, and a complementary printing is carried out.

9. An apparatus according to claim 6, further comprising a changing means for changing a threshold level of the amount of the image data for the selection in response to at least one of variation of ejection amounts information and temperature information of said at least one of ejection outlet arrays.

10. An apparatus according to claim 1, wherein said at least one of ejection outlet arrays is for ejecting black ink, and another one of said ejection outlet arrays is for ejecting color ink.

11. An apparatus according to claim 1, wherein said print means includes an element for generating enough thermal energy to generate film boiling in the ink to eject the ink.

12. An ink jet printing method comprising:

a preparing step, of preparing a print means having a plurality of ejection outlet arrays, each having a plurality of ejection outlets, arranged in a predetermined direction, for ejecting ink;

a scanning step, of moving the print means relative to the print medium in a main scan direction, which is different from the predetermined direction, during a printing operation;

a feeding step, of feeding the print medium relative to the print means in a direction which is different from the main scan direction, wherein an image is formed on the print medium while repeating scanning operation of said scanning step and feeding operation of said feeding step; and wherein one of the ejection outlet arrays extends over a wider range than another one of the ejection outlet arrays in the predetermined direction;

an information obtaining step, of obtaining image information corresponding to at least one of the ejection outlet arrays with respect to a predetermined area of image data to be printed in a prior scan, which predetermined area corresponds to a portion adjacent to a region to be printed in a later scan;

a selecting step, of selecting a portion in the at least one of ejection outlet arrays to effect printing for the image data in the predetermined area, on the basis of the information obtained by said information obtaining step about image formations; and a forming step, of forming an image with a portion in the ejection outlet array selected by said selecting step, wherein, in said selecting step, a use or non-use is selected of opposite end portions of a range to be used for recording by the at least one of ejection outlet arrays, on the basis of the information obtained in said information obtaining step.

13. A method according to claim 12, wherein said information obtaining step obtains the information which relates to an amount of the image data corresponding to single ejections from the ejection outlets in the at least one of ejection outlet arrays, for the predetermined area.

14. A method according to claim 12, wherein the at least one of ejection outlet arrays has ejection outlets arranged over a range larger than a distance through which said sheet feeding step feeds the print medium by one feeding operation, and said selecting step selects at least one portion of the ejection outlet array having the ejection outlets arranged over a range larger than the distance.

15. A method according to claim 12, wherein the at least one of ejection outlet arrays and another one of the ejection outlet arrays are disposed with deviation in a scanning direction of said scanning step and with deviation in the feeding direction through a distance of 1 feeding operation of said feeding step.

16. A method according to claim 12, wherein the ejection outlet arrays are for ejecting different inks having different compositions.

17. A method according to claim 14, wherein said selecting step selects a downstream portion in the at least one of ejection outlet arrays with respect to the sheet feeding direction when an amount of the image data corresponding to the at least one of ejection outlet arrays for the predetermined area is relatively small, and selects an upstream portion in the at least one of ejection outlet arrays with respect to the sheet feeding direction when the amount of the image data corresponding to the at least one of ejection outlet arrays for the predetermined area is relatively large.

18. A method according to claim 14, wherein said selecting step selects a downstream portion in the at least one of ejection outlet arrays with respect to the sheet feeding direction when an amount of the image data corresponding to the at least one of ejection outlet arrays for the predetermined area is relatively small, and selects an upstream portion in the at least one of ejection outlet arrays with respect to the sheet feeding direction when the amount of the image data corresponding to the at least one of ejection outlet arrays for the predetermined area is relatively large, and wherein when the amount of the image data is medium, said selecting step selects both the downstream portion and the upstream portion, and a complementary printing is carried out.

19. A method according to claim 18, wherein when the image data corresponding to the at least one of ejection outlet arrays occupy substantially and the entirety of the predetermined area, said selecting step selects both the downstream portion and the upstream portion, and a complementary printing is carried out.

20. A method according to claim 17, further comprising changing step for changing a threshold level of the amount of the image data for the selection in response to at least one of variation of ejection amounts information and temperature information of the at least one of ejection outlet arrays.

21. A method according to claim 12, wherein the at least one of ejection outlet arrays is for ejecting black ink, and another one of the ejection outlet arrays is for ejecting color ink.

22. A method according to claim 12, wherein said print step includes an element for generating enough thermal energy to generate film boiling in the ink to eject the ink.

* * * * *

UNITED STATES PATENT AND TRADEMARK OFFICE

CERTIFICATE OF CORRECTION

PATENT NO. : 6,755,496 B2
DATED : June 29, 2004
INVENTOR(S) : Hitoshi Nishikori et al.

It is certified that error appears in the above-identified patent and that said Letters Patent is hereby corrected as shown below:

Title page,
Item [57], ABSTRACT,
Line 2, "ink,;" should read -- ink; --.
Item [75], Inventors, "Hitoshi Nishikori, Tokyo (JP); should read -- Hitoshi Nishikori, Inagi (JP); --; "Naoji Otsuka, Kanagawa-ken (JP);" should read -- Naoji Otsuka, Yokohama (JP) --; "Hitoshi Sugimoto, Kanagawa-ken (JP);" should read -- Hitoshi Sugimoto, Yokohama (JP); --; "Kiichiro Takahashi, Kanagawa-ken (JP);" should read -- Kiichiro Takahashi, Kawasaki (JP); --; "Minoru Teshigawara, Kanagawa-ken (JP);" should read -- Minoru Teshigawara, Yokohama (JP); --; "Takeshi Yazawa, Kanaga-ken (JP);" should read -- Takeshi Yazawa, Kawasaki (JP); --; and "Toshiyuki Chikuma, Kanagawa-ken (JP);" should read -- Toshiyuki Chikuma, Kawasaki (JP); --.

Drawings,
Sheet 4, Figure 5, "RCURY SW" should read -- RCVRY SW --.

Column 1,
Line 16, "an" should read -- a --;
Line 40, "bleeding"." should read -- bleeding"). --;
Line 45, "BK1" should read -- Bk1 --; and
Line 46, "ejected" should read -- ejecting --.

Column 2,
Line 5, "an" should read -- a --;
Line 36, "a small," should read -- small, --; and
Line 48, "does deteriorating" should read -- as does deterioration of --.

Column 3,
Line 10, "inventors" should read -- inventors' --; and
Line 23, "and" should read -- or --.

Column 4,
Line 2, "decrease" should read -- decreases --;
Line 25, "be" should read -- been --; and
Line 46, "obtain" should read -- obtaining --.

UNITED STATES PATENT AND TRADEMARK OFFICE

CERTIFICATE OF CORRECTION

PATENT NO. : 6,755,496 B2
DATED : June 29, 2004
INVENTOR(S) : Hitoshi Nishikori et al.

It is certified that error appears in the above-identified patent and that said Letters Patent is hereby corrected as shown below:

Column 5,
Line 21, “more” should be deleted;
Line 22, “selected” should read -- selected more --;
Lines 35 and 41, “Shows” should read -- shows --;
Line 55, “Is” should read -- is --; and
Line 63, “is a schematic view” should read -- are schematic views --.

Column 6,
Line 13, “accompaniment” should read -- accompanying --;
Line 18, “Figure” should read -- figure --;
Line 19, “weather” should read -- whether --; and
Line 38, “patter” should read -- pattern --.

Column 7,
Line 28, “ed” should be deleted .

Column 8,
Line 19, “indicated” should read -- indicated by --;
Line 26, “Bk1” should read -- Bk1 --;
Line 29, “an” should read -- a’ --;
Line 31, “quatized” should read -- quantized --;
Line 44, “of a” should read -- of --; and
Line 47, “is” should read -- are --.

Column 10,
Line 24, “patten” should read -- pattern -- “FIG. 9, (b),” should read -- FIG. 9B, --;
Line 43, “2 shown” should read -- 2 shown in --; and
Line 45, “our” should read -- are --.

Column 12,
Line 6, “In the show an” should read -- As an --;
Line 20, “step s41,” should read -- step S41, --
Line 37, “FIG. 9, (b),” should read -- FIG. 9B, --; and
Line 56, “step s59,” should read -- step S59, --.

UNITED STATES PATENT AND TRADEMARK OFFICE

CERTIFICATE OF CORRECTION

PATENT NO. : 6,755,496 B2
DATED : June 29, 2004
INVENTOR(S) : Hitoshi Nishikori et al.

It is certified that error appears in the above-identified patent and that said Letters Patent is hereby corrected as shown below:

Column 13,
Line 1, “shown” should read -- shown in --;
Line 3, “pattern” should read -- patterns --;
Line 21, “parameters” should read -- parameter --;
Line 29, “formations” should read -- formation --;
Line 33, “polarity” should read -- plurality --;
Line 38, “but the combination” should be deleted;
Line 49, “but the present intention” should be deleted;
Line 55, “with respective” should be deleted;
Line 63, “limiting” should read -- limited --;
Line 65, “an” should be deleted --; and
Line 67, “element.” should read -- elements. --.

Column 14,
Line 9, “short” should read -- shot --.

Signed and Sealed this

Twenty-eighth Day of September, 2004

JON W. DUDAS
*Director of the United States Patent and Trademark Office*